US008284004B2

(12) United States Patent
Tegart

(10) Patent No.: US 8,284,004 B2
(45) Date of Patent: Oct. 9, 2012

(54) HEAT PIPE SUPPLEMENTED TRANSFORMER COOLING

(75) Inventor: Don A Tegart, Mississauga (CA)

(73) Assignee: Honeywell International Inc., Morristown, NJ (US)

( * ) Notice: Subject to any disclaimer, the term of this patent is extended or adjusted under 35 U.S.C. 154(b) by 1337 days.

(21) Appl. No.: 11/605,286

(22) Filed: Nov. 29, 2006

(65) Prior Publication Data

US 2008/0122566 A1 May 29, 2008

(51) Int. Cl.
*H01F 27/08* (2006.01)
*H01F 27/10* (2006.01)
*H01F 27/02* (2006.01)

(52) U.S. Cl. ..... 336/61; 336/55; 336/57; 336/58; 336/59; 336/60; 336/62

(58) Field of Classification Search ..... 336/55, 336/57–62
See application file for complete search history.

(56) References Cited

U.S. PATENT DOCUMENTS

| | | | | |
|---|---|---|---|---|
| 853,843 | A | 5/1907 | Troy | |
| 1,803,505 | A | 5/1931 | MacLeod | |
| 3,073,885 | A | 1/1963 | Camilli | |
| 3,371,299 | A | 2/1968 | Radkowski et al. | |
| 3,541,487 | A * | 11/1970 | Leonard | 336/58 |
| 4,009,417 | A | 2/1977 | Waldon et al. | |
| 4,009,418 | A | 2/1977 | Bennett | |
| 4,039,990 | A | 8/1977 | Philp | |
| 4,145,679 | A | 3/1979 | Mitchell, Jr. | |
| 4,173,747 | A | 11/1979 | Grimes et al. | |
| 4,337,569 | A | 7/1982 | Pierce | |
| 5,469,124 | A * | 11/1995 | O'Donnell et al. | 336/61 |
| 5,473,302 | A | 12/1995 | Terlop et al. | |
| 5,682,292 | A * | 10/1997 | Salanki | 361/699 |
| 6,041,850 | A * | 3/2000 | Esser et al. | 165/104.33 |

(Continued)

FOREIGN PATENT DOCUMENTS

JP 03124007 A * 5/1991

(Continued)

OTHER PUBLICATIONS

Improvement of the Cooling Process of Oil-Immersed Electrical Tansformers Using Heat Pipes; Rosas et al.; IEEE Transactions on Power Delivery, vol. 20, No. 3, Jul. 2005; pp. 1955-1961.

(Continued)

*Primary Examiner* — Mohamad Musleh
*Assistant Examiner* — Tsz Chan
(74) *Attorney, Agent, or Firm* — Shimokaji & Assoc., PC

(57) ABSTRACT

A method for cooling a transformer and transformer apparatuses are implemented. A transformer apparatus, according to one embodiment, comprises: a conduction cooled electrical transformer (240) mounted to a cold plate (252); and a heat pipe (262) for supplementing cooling of the transformer (240), the heat pipe (262) comprising a first end (303), a second end (305), and a sealed low pressure cavity containing an amount of a fluid (311), wherein the first end (303) of the heat pipe (262) is located in a hot region of the transformer (240), the second end (305) is maintained colder than the first end (303) by contact with the cold plate (252), and heat produced at the first end (303) by operation of the transformer (240) is moved to the second end (305) by a closed loop vapor cycle in the sealed low pressure cavity using the fluid (311) of the heat pipe (262).

16 Claims, 3 Drawing Sheets

U.S. PATENT DOCUMENTS

| | | | | |
|---|---|---|---|---|
| 6,838,968 | B2 | 1/2005 | Nick et al. | |
| 2006/0044742 | A1 * | 3/2006 | Kaishian et al. | 361/681 |

FOREIGN PATENT DOCUMENTS

| | | | | |
|---|---|---|---|---|
| JP | 07037725 | A | * | 2/1995 |
| JP | 07-220936 | A | | 8/1995 |
| JP | 2001167938 | A | * | 6/2001 |
| WO | WO 2004084368 | A1 | * | 9/2004 |

OTHER PUBLICATIONS

Cooling of Low-Power High-Voltage Transformers by Means of Thermosiphons; Beinusov et al.; Elektrotekhnika, vol. 49, No. 11, pp. 42-44, 1978.

Promotional Brochure—"Heat Pipe Technology/for a Changing World"; published by Thermacore/Modine Manufacturing Company, May 2006.

* cited by examiner

HEAT PIPE SUPPLEMENTED TRANSFORMER COOLING

BACKGROUND OF THE INVENTION

1. Field of the Invention

The present invention relates to a cooling method and apparatus, and more particularly, to a cooling method and apparatus for a transformer, using a heat pipe.

2. Description of the Related Art

Electrical transformers are ubiquitous devices used for energy transfer and conversion. During operation, transformers heat up due to a plurality of factors. For example, current flowing through the transformer windings causes resistive heating of the transformer conductors, and consequently, heat dissipates from the conductors. Induced eddy currents may circulate within the core of the transformer, causing resistive heating. The heat produced by eddy currents in the core radiates out to other components of the transformer. Residual DC currents in the transformer also lead to transformer heating. Hence, transformer heating accompanies transformer operation. The amount of heat dissipated during transformer operation depends on the transformer size, weight, etc., and on the magnitude of voltages handled by the transformer.

Transformers typically have a large thermal resistance across their body. Due to large thermal resistances, conduction cooled transformers mounted on a cold plate often exhibit a large temperature delta across the distance from the cold plate to the hottest location on the transformer.

Disclosed embodiments of this application address these and other issues by utilizing a heat pipe supplemented cooling for a transformer. In accordance with the present invention, heat pipes are introduced in a transformer so that cooling is effectively applied to both sides (or multiple locations) of the transformer, thereby effectively reducing the thermal resistance across the transformer to the cold plate used to cool the transformer. This results in a cooler operating transformer, and/or a smaller and lighter transformer performing the same functions as larger transformers. According to one embodiment of the present invention, one or more heat pipes are embedded/introduced at various locations inside a conduction cooled transformer. Heat pipes efficiently move heat from transformer hotspots to a cold plate or other cold side of the transformer assembly. Heat pipes are evacuated devices that contain an amount of fluid. Heat dissipated from an operating transformer vaporizes fluid inside the heat pipes, and the formed vapors transport heat to regions of the heat pipes that are kept colder than the operating transformer.

SUMMARY OF THE INVENTION

The present invention is directed to a method for cooling a transformer and to transformer apparatuses. According to a first aspect of the present invention, a transformer apparatus comprises: a conduction cooled electrical transformer mounted to a cold plate; and a heat pipe for supplementing cooling of the transformer, the heat pipe comprising a first end, a second end, and a sealed low pressure cavity containing an amount of a fluid, wherein the first end of the heat pipe is located in a hot region of the transformer, the second end is maintained colder than the first end by contact with the cold plate, and heat produced at the first end by operation of the transformer is moved to the second end by a closed loop vapor cycle in the sealed low pressure cavity using the fluid of the heat pipe.

According to a second aspect of the present invention, a transformer apparatus comprises: an electrical transformer mounted to a cold plate; and a heat pipe for supplementing cooling of the transformer, the heat pipe comprising a first end, a second end, and a sealed low pressure cavity containing an amount of a fluid, wherein the first end of the heat pipe is immovably embedded in a hot region of the transformer, the second end is maintained colder than the first end by contact with the cold plate, and heat produced at the first end by operation of the transformer is moved to the second end by a closed loop vapor cycle in the sealed low pressure cavity using the fluid of the heat pipe.

According to a third aspect of the present invention, a method for cooling a transformer comprises: cooling the transformer by conduction; and enhancing cooling of the transformer using a heat pipe, the enhancing step including placing a first end of the heat pipe in a hotspot region of the transformer, maintaining a second end of the heat pipe colder than the first end, and moving heat from the first end to the second end by vaporizing a fluid in a sealed low pressure cavity of the heat pipe, transporting the vaporized fluid to the second end, condensing the vaporized fluid, and returning the condensed fluid to the first end by a capillary action along a wall of the heat pipe.

BRIEF DESCRIPTION OF THE DRAWINGS

Further aspects and advantages of the present invention will become apparent upon reading the following detailed description in conjunction with the accompanying drawings, which are given by way of illustration only and, thus, are not limitative of the present invention. In these drawings, similar elements are referred to using similar reference numbers, wherein.

DETAILED DESCRIPTION

Figure 1:
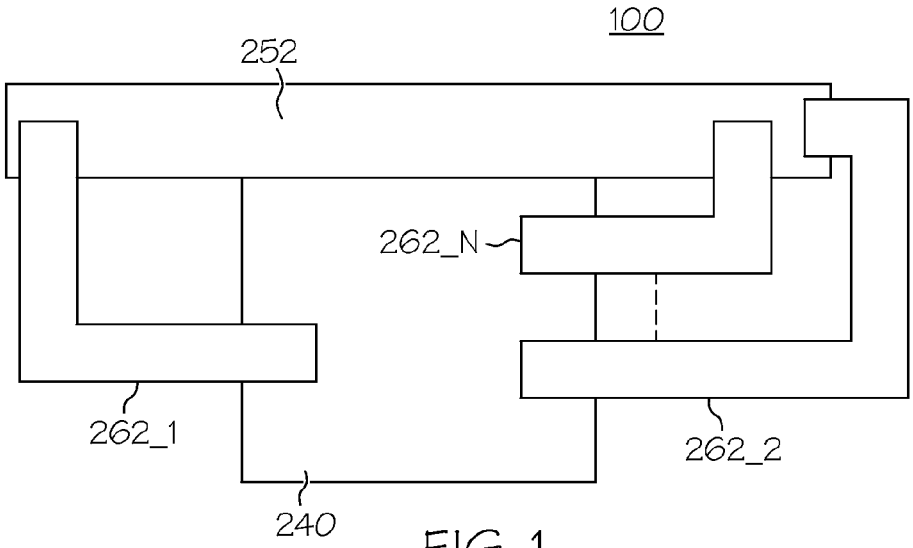
FIG. 1 is a general block diagram of a system containing a transformer with heat pipe supplemented cooling according to an embodiment of the present invention.

Aspects of the invention are more specifically set forth in the accompanying description with reference to the appended figures. FIG. 1 is a general block diagram of a system containing a transformer with heat pipe supplemented cooling according to an embodiment of the present invention. The system 100 illustrated in FIG. 1 includes the following components: a cold plate 252; a transformer 240; and heat pipes 262_1, 262_2, . . . , 262_N. Operation of the system 100 in FIG. 1 will become apparent from the following discussion.

System 100 may be associated with an aircraft, a ship, a laboratory facility, an industrial environment, a residential environment, etc. The cold plate 252 is at a lower temperature than the transformer 240. The cold plate 252 may be any type of system maintained at a lower temperature. The cold plate 252 may be, for example, part of a refrigerant system, air cooled system, water cooled system, etc.

Transformer 240 heats up during its operation. The transformer 240 may be any type of transformer used, for example, in aerospace systems, in vehicles, in laboratory facilities, etc. Heat pipes 262_1, 262_2, . . . , 262_N are located in various regions of the transformer 240, and transport heat from the transformer 240 to the cold plate 252.

Although the systems and elements in system 100 are shown as discrete units, it should be recognized that this illustration is for ease of explanation and that the associated functions of certain functional modules can be performed by one or more physical elements.

Figure 2:
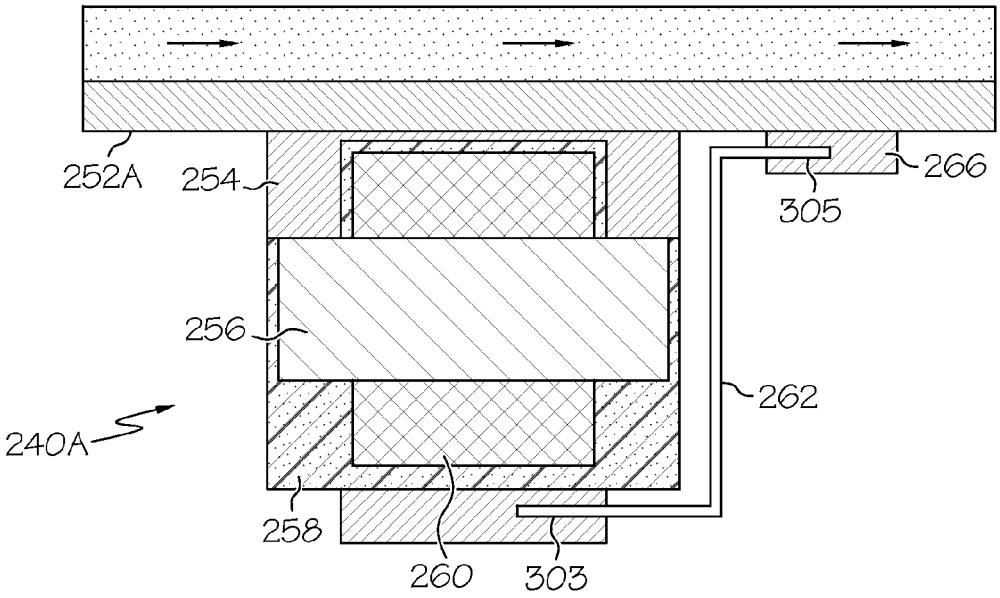
FIG. 2 illustrates a transformer with heat pipe supplemented cooling according to an embodiment of the present invention.

FIG. 2 illustrates a transformer with heat pipe supplemented cooling according to an embodiment of the present invention.

The transformer 240A illustrated in FIG. 2 includes a transformer core 256, windings 260, an optional epoxy filling 258, and a mounting base 254. The transformer core 256 may be, for example, a core made of a magnetic material, a conductive material, etc. The windings 260 may include, for example, wires, coils, electrical insulations, enameled wires, other types of conductors, etc. The transformer 240A is cooled through mounting base 254. The windings 260 may be protected by layers of epoxy 258. Epoxy layers 258 protect the transformer in damp or dirty environments, for example.

During operation, the transformer 240A heats up. The heating of the transformer is due to a plurality of factors. For example, the current flowing through the windings 260 causes resistive heating of the conductors. Induced eddy currents may circulate within the core 256, causing resistive heating.

The transformer 240A may be conduction cooled. A cold plate 252A is connected to one end of the transformer 240A, to cool the transformer. A cooling media is found on a side of the cold plate 252A. Such cooling media may be liquid, air, etc.

One or more heat pipes 262 are integrated into the transformer assembly to move heat from the transformer hotspots. The heat pipes 262 are embedded or inserted into the transformer 240A. The heat pipes are heat sunk to the cold plate, which is in turn cooled either by a cooled liquid loop, or by forced air, natural convection cooling, etc. The transformer is clamped to a metal block that is used to conduct the heat away from the core 256. The metal block may be the cold plate. In one embodiment, the metal block is made of aluminum. The heat path out of the windings is typically through a thermal pad (to accommodate the tolerance variation of the windings) and into the base mounting block. From the base mounting block, the heat is transferred to the cold plate/metal block. Heat is then transferred to the heating and ventilation system. If the transformer is used in an aircraft, then the Environmental Control System (ECS) will finally disperse the heat.

Transformer hotspots include the top of the windings, the hop in a conduction cooled transformer design, locations on one end of the transformer at the transformer evaporator end, locations at transformer heat sink ends such as locations where heat sinks to a cold plate at a transformer condenser end, etc. As illustrated in FIG. 2, an exemplary heat pipe 262 may transport heat from a hot end 303 (evaporator end), to a cold end 305 (condenser end) placed in a cold support 266 that is kept cold by the cold plate 252A.

The orientations of the heat pipes may affect the performance of the heat pipes. In a preferred embodiment, the condenser end 305 of the heat pipe is located above the evaporator end 303. However, the cooling functions of the heat pipe can still be performed even if the condenser end is not above the evaporator end.

The heat pipe is a "heat transport" device that has a very low thermal resistance over a large distance. A heat pipe uses a closed loop vapor cycle with no moving parts. One end of the heat pipe, the evaporator end, is at a hot location of the transformer. Another end of the heat pipe, the condenser end, is mounted to the cold plate, which could be air cooled, liquid cooled, etc.

Since heat pipe cooling is applied to two sides or to multiple sides or locations of the transformer, the distance to the cooling media (for example, to the cold plate) is effectively reduced. With an effectively reduced distance to the cooling media, the temperature rise (delta T) of the transformer 240A is significantly reduced.

Heat pipes transport the heat to the mounting base of the transformer, and can fit within the normal mounting footprint of the transformer. Heat pipes can also transport heat to a remote location farther away from the transformer, to help spread the thermal load over a larger area of the cold plate. Conduction cooled transformers may be packaged with or without potting material. Potted transformers are heavier than non-potted ones. If potted, the transformer assembly can be potted in a thermally conductive epoxy, to help transfer the heat load to the heat pipes and eliminate localized hotspots.

In one exemplary embodiment, heat pipes are subsequently attached to the packaged transformers. In another exemplary embodiment, heat pipes are packaged initially with the transformers.

One of the primary advantages of the present invention is that it is compatible with, and allows the use of standard transformer designs and manufacturing processes. According to the present invention, heat pipes may be added onto an existing transformer that is already cooled by a mounting base, and by thermally conductive epoxy, if epoxy is used. Because of insufficient cooling provided by a standard conduction cooling setup, the transformer may be overheating. The present invention provides supplemental/enhanced cooling by heat pipes, for conduction cooled transformer designs. The heat pipe supplemented cooling described in the current invention can be used to implement cooler operating transformers, lighter transformers that can retain and perform the same functions as heavier transformers, etc.

Figure 3A:
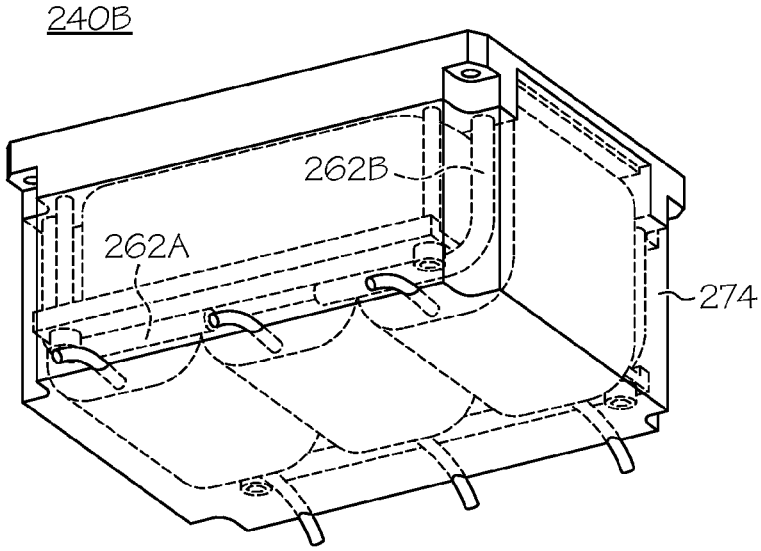
FIG. 3A illustrates a potted transformer with heat pipe supplemented cooling according to an embodiment of the present invention.

FIG. 3A illustrates a potted transformer with heat pipe supplemented cooling according to an embodiment of the present invention. The transformer 240B is potted with thermally conductive potting 274. For example, the final assembly of the transformer may be potted with thermally conductive epoxy to improve thermal conductivity. The thermally conductive epoxy helps transfer the heat load to the heat pipes and eliminates localized hotspots. Two heat pipes 262A and 262B are illustrated, and more heat pipes may be present.

Figure 3B:
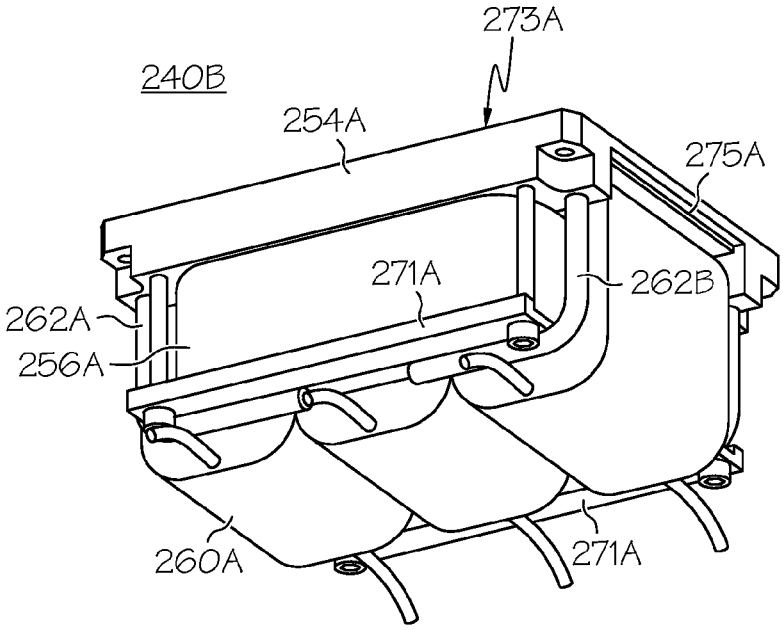
FIG. 3B illustrates internal details of a potted transformer with heat pipe supplemented cooling according to an embodiment of the present invention illustrated in FIG. 3A.

FIG. 3B illustrates internal details of the potted transformer with heat pipe supplemented cooling according to an embodiment of the present invention illustrated in FIG. 3A. FIG. 3B illustrates the same transformer as FIG. 3A. Internal details of the transformer are visible, and the thermally conductive potting is hidden. Heat pipes 262A and 262B are embedded into the mounting base 254A and into the potting. Clamps 271A secure the position of the core 256A. The top surface 273A is cooled by contact with a cooling region such as a cold plate. The transformer 240B may include an optional thermal pad 275A.

Figure 4:
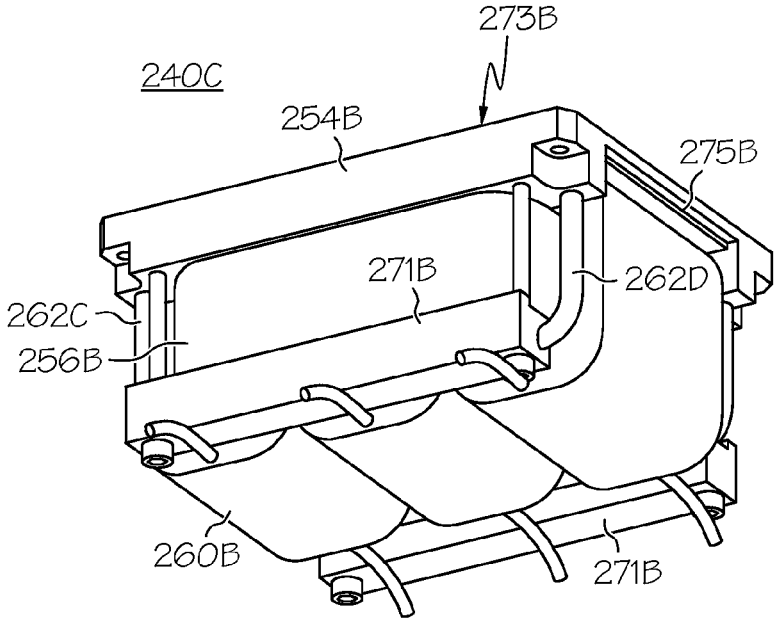
FIG. 4 illustrates a non potted transformer with heat pipe supplemented cooling according to an embodiment of the present invention.

FIG. 4 illustrates a non-potted transformer with heat pipe supplemented cooling according to an embodiment of the present invention. The transformer 240C without thermally conductive potting, includes heat pipes, such as heat pipes 262C and 262D, embedded into the mounting base 254B and into the clamps 271B. Hence, the clamps are cooled by the heat pipes. Clamps 271B secure the position of the core 256B. The top surface 273B is cooled by contact with a cooling region such as a cold plate. The transformer 240C may include an optional thermal pad 275B.

Figure 5:
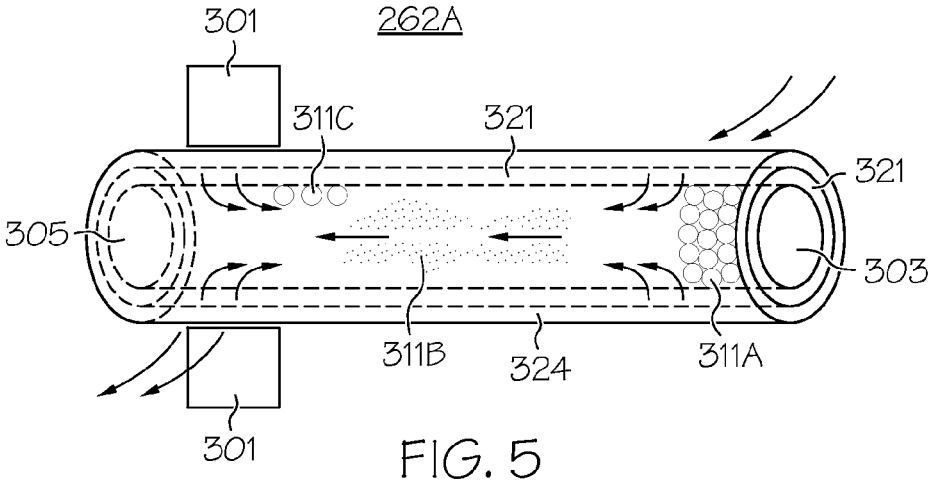
FIG. 5 illustrates an exemplary heat pipe used for heat pipe supplemented transformer cooling according to an embodiment of the present invention illustrated in FIG. 2.

FIG. 5 an exemplary heat pipe 262A used for heat pipe supplemented transformer cooling according to an embodiment of the present invention illustrated in FIG. 2. The heat pipe 262A helps improve the thermal conductivity across a conduction-cooled transformer mounted to a cold plate, where the cold plate is cooled using liquid cooling means, air cooling means, or other cooling means.

Heat pipes are two-phase heat transfer devices that use vaporization of a small amount of liquid inside the heat pipe at a hot end of the heat pipe device, and condensation at the cold end of the heat pipe device, to transfer heat over a distance between the hot end and the cold end. Heat pipes are self-contained devices that have no moving parts to wear out; do not require energy to operate, and do not need maintenance and have extremely high effective thermal conductivity. Depending on transformer size and power, associated heat pipes can be designed to carry the needed amount of watts or kilowatts. Heat pipes are highly reliable, and typically last for years or decades.

Heat pipes may be located in a variety of positions, and can transfer heat to any areas. Hence, heat pipe 262A may be located anywhere inside transformer 240A, and may be designed to transfer heat to locations where heat dissipation is effectively managed. Heat pipes are low cost and can be manufactured in any configuration needed.

Figure 6:
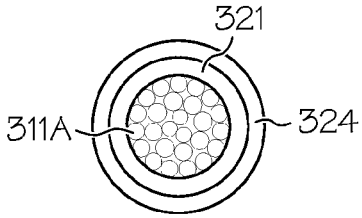
FIG. 6 illustrates a transverse view of the heat pipe of FIG. 5.

FIG. 5 and FIG. 6 illustrate an exemplary heat pipe design. The heat pipe is an evacuated device that contains a small quantity of fluid 311A. An evaporator end 303 of the heat pipe is heated by a heat flux, such as the heat produced by transformer 240A operation. The heat flux initiates a passive evaporation and condensation cycle in the heat pipe. The inner surface of the heat pipe 262A is lined with a capillary wicking material 321, which contributes to fluid transport. Heat is absorbed at the evaporator section 303 and vaporizes some of the fluid 311A. The fluid 311A boils at any temperature above the fluid freezing point, because the heat pipe is an evacuated device. Hence, as soon as any heat reaches the evaporator end 303, vaporization of the fluid 311A occurs and the heat pipe begins to operate.

Vaporized fluid 311B travels to the cold condenser end 305, hence transporting heat to the condenser region 305. The condenser end 305 is kept cold by a cold system or medium 301. The vapor 311B condenses at the condenser end 305 and releases heat to the cold system or medium 301. The condensed working fluid 311C is returned to the evaporator end 303, by the capillary action of the wick structure 321.

Exemplary working fluids 311A used inside a heat pipe include water, acetone, and methanol. Other fluids may also be used. The heat pipe external casing 324 may be made of a variety of materials, such as, for example, copper, stainless steels, superalloys, refractory metals, etc. Other materials may also be used for the external casing.

The wick structure of heat pipe 252A can be of various kinds. In exemplary embodiments, a grooved wick structure, a screen mesh wick structure, or a sintered powder wick structure may be used. Various materials may be used to make the wick 321. The wick 321 may also be absent in an exemplary embodiment.

The geometry, structure, and surface size of the wick 321, the pipe 262A diameter and length, and the type of fluid 311A, influence the heat flux capability of the heat pipe and the angles of operation of the heat pipe. For example, heat pipes may transport heat both in the direction of gravity, and against gravity. Hence, heat pipes may have many orientations, as needed, inside transformer 240A. Heat pipes may be customized for transformer type and power, transformer spatial orientation, locations inside the transformer, etc.

Any type of heat pipes, including off-the-shelf heat pipes, may be used for transformer cooling as described in the current application. A few exemplary types of heat pipes, which may be used for transformer cooling as described in the current invention, are described in the scientific and promotional brochure "Heat Pipe Technology for a Changing World", published by Thermacore/Modine Manufacturing Company, May 2006, the entire contents of which are hereby incorporated by reference.

According to the present invention, heat pipes are used to supplement transformer cooling for various size transformers. In a preferred embodiment, heat pipe supplemented cooling is implemented for transformers used in aerospace applications.

The heat pipe supplemented transformer can be used for a variety of applications. The heat pipes can be customized to a desired cooling rate for the transformer and to a desired weight. Aspects of the present invention are applicable to a wide variety of environments. Aspects of the present invention are particularly applicable in environments where weight savings are desired, such as in aerospace systems.

I claim:

1. A transformer apparatus, said apparatus comprising:

a conduction cooled electrical transformer mounted to a cold plate; and a heat pipe for supplementing cooling of said transformer, said heat pipe comprising a first end, a second end, and a sealed low pressure cavity between the first end and the second end, the sealed low pressure cavity containing an amount of a fluid, wherein said sealed low pressure cavity is disposed entirely exterior to a transformer core and a transformer winding, the sealed low pressure cavity having a bend of about 90 degrees to permit the sealed low pressure cavity to bend around an exterior of the transformer;

said first end of said heat pipe is located in a hot region of said transformer, said second end is maintained colder than said first end by contact with said cold plate, and heat produced at said first end by operation of said transformer is moved to said second end by a closed loop vapor cycle in said sealed low pressure cavity using said fluid of said heat pipe.

2. The transformer apparatus according to claim 1, wherein during said closed loop vapor cycle, said heat produced at said first end by operation of said transformer vaporizes a part of said fluid, said vaporized fluid travels to said second end and condenses, and said condensed fluid is returned to said first end by a capillary action along a wall of said heat pipe.

3. The transformer apparatus according to claim 2, wherein said capillary action along a wall of said heat pipe is achieved using a wick structure along said wall of said heat pipe between said first end and said second end.

4. The transformer apparatus according to claim 1, wherein said first end of said sealed low pressure cavity is embedded in said hotspot region of said electrical transformer.

5. The transformer apparatus according to claim 1, wherein said heat pipe reduces the thermal resistance across said transformer to said cold plate.

6. The transformer apparatus according to claim 1, wherein said heat pipe has no moving parts.

7. The transformer apparatus according to claim 1, wherein said second end of said heat pipe is located above said first end of said heat pipe.

8. The transformer apparatus according to claim 1, wherein said second end is located at a remote location from said transformer, to help spread the thermal load from said transformer over a larger area of said cold plate.

9. The transformer apparatus according to claim 1, wherein said transformer is potted in a thermally conductive potting to transfer a transformer heat load to said heat pipe and eliminate localized hotspots, and said heat pipe is embedded into said potting and into a base of said transformer.

10. The transformer apparatus according to claim 1, wherein said transformer is not potted, and said second end is embedded into clamps and into a base of said transformer, wherein said clamps secure a position of the transformer core.

11. The transformer apparatus according to claim 1, wherein said cold plate is maintained colder than said first end by one of a cooled liquid loop system, forced air system, and natural convection cooling system.

12. The transformer apparatus according to claim 1, wherein said transformer is clamped to an aluminum block used to conduct heat away from the core of said transformer.

13. The transformer apparatus according to claim 1, wherein said transformer does not include a liquid immersion portion or a fluid tank.

14. The transformer apparatus according to claim 1, wherein said first end is immovably embedded in a region of said transformer.

15. A transformer apparatus, said apparatus comprising:

an electrical transformer having a first side mounted to a cold plate; and a heat pipe for supplementing cooling of said transformer, said heat pipe comprising a first end, a second end, and a sealed low pressure cavity containing an amount of a fluid, wherein said first end of said heat pipe is immovably embedded in a hot region of said transformer, the hot region being disposed on a second side of the transformer, said sealed low pressure cavity being entirely exterior of a transformer core and a transformer winding, the sealed low pressure cavity having a bend to permit the sealed low pressure cavity to conform to an exterior shape of the transformer, the second side being opposite the first side of the transformer, said second end is maintained colder than said first end by contact with said cold plate, and heat produced at said first end by operation of said transformer is moved to said second end by a closed loop vapor cycle in said sealed low pressure cavity using said fluid of said heat pipe.

16. The transformer apparatus according to claim 15, wherein said transformer is used in aerospace applications, a plurality of said heat pipes have their first ends immovably embedded in a plurality of hot regions of said transformer, to supplement cooling of said transformer.

* * * * *